US007741766B2

(12) United States Patent
Park

(10) Patent No.: US 7,741,766 B2
(45) Date of Patent: Jun. 22, 2010

(54) COMPOSITION FOR FORMING LAYER, FLUORESCENT LAMP USING THE COMPOSITION, AND METHOD OF MANUFACTURING A FLUORESCENT LAMP

(75) Inventor: Yong-Seok Park, Seoul (KR)

(73) Assignee: DMS Co., Ltd., Suwon, Kyungki-Do (KR)

( * ) Notice: Subject to any disclaimer, the term of this patent is extended or adjusted under 35 U.S.C. 154(b) by 711 days.

(21) Appl. No.: 11/637,320

(22) Filed: Dec. 11, 2006

(65) Prior Publication Data

US 2007/0159053 A1 Jul. 12, 2007

(30) Foreign Application Priority Data

Dec. 26, 2005 (KR) ..... 10-2005-0129677

(51) Int. Cl.
*H01J 61/02* (2006.01)

(52) U.S. Cl. ..... 313/489; 427/67

(58) Field of Classification Search ..... 313/485–489; 427/67

See application file for complete search history.

(56) References Cited

U.S. PATENT DOCUMENTS

| | | | | |
|---|---|---|---|---|
| 4,058,639 | A | 11/1977 | Schreurs | |
| 4,691,140 | A | 9/1987 | Sakakibara | |
| 5,417,886 | A * | 5/1995 | Tateiwa et al. | 252/301.4 R |
| 6,555,958 | B1 * | 4/2003 | Srivastava et al. | 313/506 |
| 2003/0076042 | A1 * | 4/2003 | Soules et al. | 313/635 |
| 2003/0160554 | A1 * | 8/2003 | Soules et al. | 313/272 |
| 2005/0062423 | A1 | 3/2005 | Shibahara | |

FOREIGN PATENT DOCUMENTS

| | | | |
|---|---|---|---|
| CN | 1672239 | | 9/2005 |
| EP | 1 111 026 | A | 6/2001 |
| EP | 1 515 361 | A | 3/2005 |
| JP | 52-093185 | | 8/1977 |
| JP | 60-105160 | A | 6/1985 |
| JP | 63-000955 | A | 1/1988 |
| JP | 03-037133 | | 2/1991 |

(Continued)

OTHER PUBLICATIONS

Tian, Yuwei, "Research on trinary eutectic electric powder for the long life-spane lamp and the method for preparing the same," China Light & Lighting, Issue 2, pp. 17-20, 2003.

*Primary Examiner*—Nimeshkumar D Patel
*Assistant Examiner*—Christopher M Raabe
(74) *Attorney, Agent, or Firm*—Ladas & Parry, LLP

(57) ABSTRACT

A slurry composition for forming a layer is provided. The slurry composition includes 100 parts by weight of a metal oxide selected from the group consisting of MgO, CaO, SrO, BaO, $ZrO_3$, and a combination thereof; 1-200 parts by weight of a binding agent per 100 parts by weight of the metal oxide, the binding agent being selected from the group consisting of calcium phosphate (CaP), a calcium-barium-boron-based (CBB-based) oxide, a triple carbonate ((Ca, Ba, Sr)$CO_3$), and a combination thereof; 1-10 parts by weight of a binder per 100 parts by weight of the metal oxide, the binder being selected from the group consisting of nitro cellulose, ethyl cellulose, methyl methacrylate, and a combination thereof; and 50-500 parts by weight of a solvent per 100 parts by weight of the metal oxide.

10 Claims, 4 Drawing Sheets

FOREIGN PATENT DOCUMENTS

| | | |
|---|---|---|
| JP | 04-147556 | 5/1992 |
| JP | 05-013047 | 1/1993 |
| JP | 08-236077 A | 9/1996 |
| JP | 09-092218 | 4/1997 |
| JP | 11-067085 | 3/1999 |
| JP | 11-167901 | 6/1999 |
| JP | 2003-036811 | 2/2003 |
| JP | 2003-091007 | 3/2003 |
| KR | 10-1999-0083535 | 11/1999 |
| KR | 10-2001-0074017 | 8/2001 |
| KR | 10-2003-0041704 | 5/2003 |
| WO | 2004/013892 A | 2/2004 |

* cited by examiner

COMPOSITION FOR FORMING LAYER, FLUORESCENT LAMP USING THE COMPOSITION, AND METHOD OF MANUFACTURING A FLUORESCENT LAMP

CROSS REFERENCE TO RELATED APPLICATION

This application claims priority to and the benefit of Korean Application No. 10-2005-0129677 filed in the Korean Patent Office on Dec. 26, 2005, the entire content of which is incorporated hereinto by reference.

Field of the Invention

The present invention relates to a composition for forming a layer, a fluorescent lamp manufactured using the composition, and a method of manufacturing the fluorescent lamp. More particularly, it relates to a composition for forming a passivation layer that is exposed to a discharge space to prevent the degradation of a glass tube and/or a phosphor layer when a fluorescent lamp is driven, which is caused by ions and electrons accelerated by a high voltage, and to increase the service life and luminance of the fluorescent lamp by suppressing an increase of mercury gas consumption. The present invention further relates to a fluorescent lamp manufactured using the composition and a method of manufacturing the fluorescent lamp.

Background of the Invention

Fluorescent lamps are classified as a cold cathode fluorescent lamp (CCFL) having an electrode disposed inside of a cylindrical glass tube and an external electrode fluorescent lamp (EEFL) having an electrode disposed outside of the glass tube.

The fluorescent lamp includes a phosphor layer formed by coating a fluorescent material on an inner wall of the glass tube, and a discharge gas including a certain content of gas and mercury for driving the light emission in the glass tube. Particularly, since the EEFL has an electrode disposed on an outer wall of the glass tube instead of the inner wall, it can be easily manufactured in the form of a capillary lamp.

Generally, when high voltage is applied to the electrode, electrons in the glass tube collide with neutral gas atoms while traveling toward an electrode (cathode electrode), thereby generating ions. The generated ions travel to an electrode (anode electrode) so that secondary electrons are emitted from the anode electrode. By the discharge, in the case of a mercury fluorescent lamp, ultraviolet rays having a wavelength of about 253.7 nm are emitted by the collision of the traveling electrons with mercury atoms. The ultraviolet rays excite the phosphor layer to emit visible rays.

In the case of a non-mercury fluorescent lamp, ultraviolet rays having a wavelength of 147 nm or 173 nm by Xenon discharge excite the phosphor layer to emit the visible rays.

A metal oxide is applied to the EEFL in order to suppress a darkening phenomenon in the fluorescent lamp using a variety of methods.

Korean Pat. No. 2001-0074017 discloses an EEFL in which a metal oxide such as MgO, or CaO is deposited on an inner surface of a glass tube in order to increase the lifetime of the fluorescent lamp and the secondary electron emission. However, the patent (2001-0074017) only estimates the effect of using the metal oxide and does not prove the effect. Furthermore, the patent does not disclose a composition of the metal oxide. Moreover, a method for forming the ferroelectric layer is not provided.

Korean Pat. No. 1999-0083535 discloses a fluorescent lamp wherein a passivation layer is interposed between a glass tube and a phosphor layer in order to suppress the darkening phenomenon and to keep a high luminous flux maintenance factor. That is, a colloid suspension is formed by dispersing $\gamma$-$Al_2O_3$ in water and then the colloid suspension is coated on a glass tube. Thereafter, the glass tube is baked at 600° C. so that the passivation layer is formed.

According to the patent 1999-0083535, only the case where the passivation layer is formed on a normal glass tube, rather than a glass micro-tube (capillary type glass tube) for the fluorescent lamp, is disclosed. Therefore, it is difficult to apply the technology disclosed in the patent to produce the EEFL having the capillary type glass tube having a relatively small diameter. Also, it is difficult to form a uniform passivation layer due to the deterioration of colloid stability, which is caused by aggregation of the —$Al_2O_3$ particles.

That is, a method of forming the metal oxide layer having a low work function is not disclosed in detail. Although a dry coating method such as deposition or sputtering may be used in order to form the metal oxide layer, it is impossible to coat a capillary type glass tube using the dry coating method.

Therefore, an EEFL having the metal oxide layer has not yet been realized, nor has it been fundamentally described.

First, in order to form the metal oxide layer inside the EEFL, a composition that may be applied to a manufacturing process of the EEFL must be provided. That is, a coating process of the composition on the inner wall of the fluorescent lamp must be easily conducted in association with the manufacturing process of the EEFL.

Second, the metal oxide layer formed by the coating process on the inner wall of the glass tube must have binding capacity, and a proper thickness and uniformity of the metal oxide layer must be ensured.

Third, the EEFL must not discharge impure gas after the coating and baking processes are conducted.

Korean Pat. No. 2003-41704 discloses a technology for removing a phosphor layer corresponding to a region of an external electrode in order to suppress a deterioration of a fluorescent substance, which is caused by the sputtering occurring inside of a glass tube. However, although the deterioration of the fluorescent substance may be prevented by the technology, this may cause a deterioration of the glass tube.

SUMMARY OF THE INVENTION

The present invention provides a composition used for forming a passivation layer on a region corresponding to an external electrode of a fluorescent lamp through a wet coating and baking processes.

The present invention also provides a fluorescent lamp having a passivation layer exposed to a discharge region, thereby preventing the deterioration of the phosphor layer or the glass tube that may be caused by ions and electrons accelerated by high voltage and suppressing an increase of mercury gas consumption, and thus remarkably increasing lifetime and luminance thereof, and a method of manufacturing the fluorescent lamp.

According to an exemplary embodiment of the present invention, there is provided a slurry composition including: 100 parts by weight of a metal oxide selected from the group consisting of MgO, CaO, SrO, BaO, $ZrO_3$, and a combination thereof; 1-200 parts by weight of a binding agent per 100 parts by weight of the metal oxide, the binding agent being selected from the group consisting of calcium phosphate (CaP), a calcium-barium-boron-based (CBB-based) oxide, a triple carbonate ((Ca, Ba, Sr)$CO_3$), and a combination thereof; 1-10 parts by weight of a binder per 100 parts by weight of the metal oxide, the binder being selected from the group consisting of nitro cellulose, ethyl cellulose, methyl methacrylate, and a combination thereof; and 50-500 parts by weight of solvent per 100 parts by weight of the metal oxide.

The slurry composition may further include one or more materials selected from the group consisting of a mercury abatement inhibitor and a dark property enhancer.

According to another exemplary embodiment of the present invention, there is provided a fluorescent lamp having a layer formed by wet-coating the slurry composition on a glass tube and baking the glass tube, and a method for manufacturing the fluorescent lamp.

The fluorescent lamp may be an EEFL (External Electrode Fluorescent Lamp) or an FFL (Flat Fluorescent Lamp).

BRIEF DESCRIPTION OF THE DRAWING

A more complete appreciation of the invention, and many of the attendant advantages thereof, will be readily apparent as the same becomes better understood by reference to the following detailed description when considered in conjunction with the accompanying drawings.

DETAILED DESCRIPTION OF THE INVENTION

Figure 1:
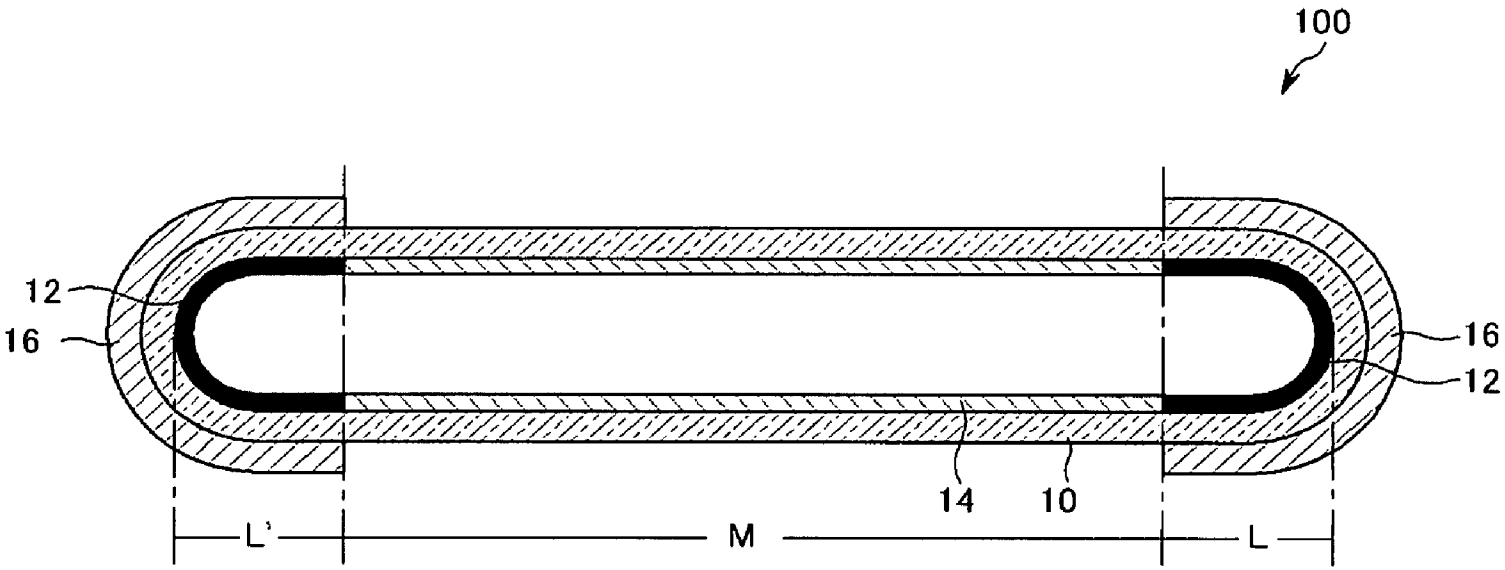
FIG. 1 is a longitudinal sectional view of an EEFL according to an exemplary embodiment of the present invention.

Reference will now be made in detail to embodiments of the invention, examples of which are shown in the accompanying drawings, wherein like reference numerals refer to like elements throughout. The embodiments are described below in order to explain the invention by referring to the figures.

A slurry composition according to the present invention can be used to form a metal oxide layer as a uniform passivation layer having good binding capacity on a glass substrate of a fluorescent lamp. Also, the slurry composition is the same as or is very compatible with a slurry composition of a phosphor layer, and thus the metal oxide and phosphor layers are formed simultaneously by conducting a baking process once.

The metal oxide layer exposed to a discharge region prevents deterioration of the glass tube or the phosphor layer, which may be caused by ions or electrons that are accelerated by high voltage, and suppresses the increase of mercury gas consumption, thereby remarkably improving the lifetime and luminance of the fluorescent lamp.

The slurry composition of the present invention includes a binder, a binding agent, the metal oxide, and a solvent. The binder and the solvent are the same as those in the slurry composition for the phosphor layer or are compatible with the slurry composition for the phosphor layer, and the binding agent increases the bonding force of the metal oxide with the glass material.

Each ingredient of the slurry composition will now be described.

(a) Metal Oxide

The metal oxide is used to form a highly durable passivation layer exposed to the discharge region, which, when the fluorescent lamp is driven, can prevent the deterioration of the phosphor layer or the glass tube, which is caused by the ions and the electrons accelerated by the high voltage. Therefore, a darkening phenomenon occurring at opposite ends of the fluorescent lamp can be prevented by effectively suppressing the increase of the mercury consumption caused by the deterioration of the phosphor layer or glass tube. Also, a secondary electron emitting rate may increase and thus the electron emission content increases, thereby lowering the drive voltage. That is, the passivation layer formed of the metal oxide reduces the drive voltage and increases the lifetime, luminance, and reliability of the fluorescent lamp.

The metal oxide may be selected from the group consisting of MgO, CaO, SrO, BaO, and ZrO, and a combination thereof. Preferably, the metal oxide may be a mixture of MgO and $ZrO_2$, and is more preferably MgO. A particle size of the metal oxide may be 0.01~100 μm, preferably 0.5~30 μm, considering dispersion stability of the slurry composition for the layer. Also, if necessary, the particle size may be further reduced through a ball-milling process. The particles of the metal oxide may be granular-shaped, spherical-shaped, or flake-shaped. Preferably, the particles of the metal oxide may be spherical-shaped.

(b) Binding Agent

The binding agent is used in order to increase the bonding force between the metal oxide and the glass tube. A conventional metal oxide passivation layer formed through a wet or dry-coating process using a slurry composition has an inferior binding capacity on a glass tube. Therefore, the passivation layer may be easily delaminated. In order to solve this problem, the slurry composition of the present invention includes a binding agent selected from the group consisting of calcium phosphate (CaP), a calcium-barium-boron-based (CBB-based) oxide, a triple carbonate ((Ca, Ba, Sr)$CO_3$), and a combination thereof.

Preferably, the binding agent may be a mixture of the CaP and the CBB-based oxide that are mixed at a predetermined ratio or a triple carbonate ((Ca, Ba, Sr)$CO_3$). In the mixture, the weight ratio of the CaP to the CBB-based oxide is within a range of 1:1-1:3, and is preferably 1:1.

The particle size of the binding agent may be within a range of 0.01-100 μm, and is preferably 0.1-10 μm, in order to have dispersion stability of the slurry composition for forming the layer. Also, if necessary, the particle size may be further reduced through a ball-milling process before using the binding agent. A particle shape of the binding agent may be granular, spherical, or flake.

The binding agent enhances the binding capacity and adhesion between the glass tube and the metal oxide. However, the content of the binding agent must be controlled properly in order to obtain an effect of the metal oxide. In order to properly perform the wet-coating process using the slurry composition, the content of the binding agent must be used within a range not affecting the dispersion stability of the slurry composition.

The binding agent may be 1-200 parts by weight, preferably 10-100 parts by weight, per 100 parts by weight of the metal oxide. If the binding agent is present at lower than 1 part by weight per 100 parts by weight of the metal oxide, the metal oxide layer may be delaminated from the phosphor layer or the inner wall of the glass tube. If the binding agent is present at higher than 200 parts by weight per 100 parts by weight of the metal oxide, the content of the metal oxide in the passivation layer is too low and thus the lifetime and luminance of the phosphor layer may be deteriorated.

When the mixture of the CaP and the CBB-based oxide is used as the binding agent, the weight ratio of the CaP to the CBB-based oxide is preferably within a range of 1:1-1:5. When the triple carbonate ((Ca, Ba, Sr)$CO_3$) is used as the binding agent, the weight ratio of the triple carbonate ((Ca, Ba, Sr)$CO_3$) to the metal oxide is preferably within a range of 1:1-1:2.

(c) Binder

The binder functions to uniformly disperse components of the slurry composition of the present invention and provides a certain viscosity for the wet coating to the slurry composition, thereby forming a uniform coating layer on the glass tube.

The binder may be selected from the group consisting of nitro cellulose, ethyl cellulose, methyl methacrylate, and a combination thereof, and is preferably the nitro cellulose.

In the slurry composition of the present invention, the binder is within a range of 1-10 parts, preferably 2-8 parts, by weight per 100 parts by weight of the metal oxide. If the binder is present at less than 1 part by weight per 100 parts by weight of the metal oxide, the viscosity of the slurry composition is too low to form a uniform coating layer on the inner wall of the glass tube. If the binder is present at greater than 10 parts by weight per 100 parts by weight of the metal oxide, the light emitting property and luminance of the fluorescent lamp are deteriorated by the residual organic after the baking.

(d) Solvent

The solvent dilutes the slurry composition including the binder, the binding agent, and the metal oxide for forming the layer, thereby making it easy to perform the wet coating.

The solvent may be selected from the group consisting of C1-C5 lower alcohol, C1-C5 alkyl acetate, C1-C4 alkyl cellosolve, xylene, toluene, and a combination thereof. Preferably, the solvent may be selected from the group consisting of water, methanol, ethanol, isopropanol, n-propanol, n-butanol, sed-butanol, t-butanol, methyl cellosolve, ethyl cellosolve, butyl cellosolve, ethyl acetate, methyl acetate, xylene, toluene, and a combination thereof. More preferably, the solvent may be butyl acetate.

In the slurry composition, a content of the solvent may be variably controlled according to the wet coating type. Preferably, the solvent may be present at 50-500 parts per 100 parts by weight of the metal oxide in order for the binder concentration to be diluted to 1~5%.

(e) Other Ingredients

The above-described slurry composition may further include other ingredients for additional purposes.

That is, the slurry composition may further include a fluorescent substance, which has been used for forming a phosphor layer of a typical fluorescent lamp, to enhance the light emitting of the fluorescent lamp. However, the content of the metal oxide may vary according to the case where it is applied. The weight ratio of the metal oxide to the fluorescent substance may be within a range of 1:100-100:1.

That is, when the slurry composition is used to form the passivation layer separately from the phosphor layer, the weight ratio of the metal oxide to the fluorescent substance in the slurry composition is within a range of 100:1-10:1. In addition, when the slurry composition is used to form a phosphor layer, the weight ratio of the metal oxide to the fluorescent substance in the slurry composition is within a range of 1:100-1:10.

Also, ions and electrons accelerated by high voltage may deteriorate the glass tube and thus the consumption of mercury gas increases. In order to prevent this problem, the slurry composition may further include a mercury abatement inhibitor selected from the group consisting of $Y_2O_3$, $CeO_2$, $Al_2O_3$, and a combination thereof. The weight ratio of the mercury abatement inhibitor to the metal oxide may be within a range of 0.5:1-1:1. That is, the content of the mercury abatement inhibitor may be equal to or less than the content of the metal oxide.

In addition, the slurry composition may further include a dark property enhancer such as cesium or a compound including the cesium to conduct a rapid drive in a dark status. For example, the dark property enhancer may be selected from the group consisting of Cs, $CsO_2$, $Cs_2O$, $Cs_2SO_4$, and $Cs(OH)_2$, and a combination thereof. Preferably, a weight ratio of the metal oxide to the dark property enhancer is within a range of 1:0.01-1:0.1. That is, the content of the dark property enhancer may be equal to or less than the content of the metal oxide.

The ingredients and weight ratios of the slurry composition for the layer are not limited to the above-described embodiment. Those skilled in the art will appreciate that various modifications and substitutions can be made thereto without departing from the spirit and scope of the present invention.

For example, the binder is dissolved in the solvent, and then the binding powder is mixed. Then, the ball milling process is conducted for 5-72 hours to reduce the particle size of the binding agent, thereby enhancing the dispersibility.

Next, a certain content of the metal oxide powder is added to the composition prepared by the above-described process, and the ball milling process is further performed for 1-48 hours, thereby preparing the slurry composition. The metal oxide powder and the binding powder may be added to the binding agent sequentially or simultaneously.

Likewise, the additives such as the fluorescent substance, the mercury abatement inhibitor, and the dark property enhancer may be added simultaneously with the binding agent or in the following process.

The slurry composition used for forming layers may vary within the above-described range.

According to a first exemplary embodiment of the present invention, a slurry composition is produced by: uniformly dispersing nitro cellulose into the butyl acetate with a 2% concentration; mixing in a binding agent in which CaP and a CBB-based oxide are mixed in the weight ratio of 1:1; conducting a ball-milling process on the resulting mixture; adding a metal oxide to the resulting mixture; and performing the ball-milling process again for the resulting composition.

At this point, the slurry composition includes, per 100 parts by weight of a metal oxide selected from the group consisting of MgO, CaO, SrO, BaO, $ZrO_2$, and a combination thereof, 1-10 parts by weight of nitro cellulose binder, 1-50 parts by weight of the binding agent in which the CaP and CBB are mixed in the weight ratio of 1:1; and 50-500 parts by weight of the butyl acetate solvent.

According to a second exemplary embodiment of the present invention, a slurry composition is produced by: uniformly dispersing nitro cellulose into butyl acetate with a 2% concentration; adding the (Ca, Ba, Sr)$CO_3$ and the zirconium oxide; performing a ball-milling process on the resulting composition; adding a metal oxide; and conducting a ball-milling process on the resulting composition. The weight ratio of the zirconium oxide to the (Ca, Ba, Sr)$CO_3$ is 1:6.

The slurry composition includes, per 100 parts by weight of the metal oxide selected from the group consisting of MgO, CaO, SrO, BaO, $ZrO_2$, and a combination thereof, 1-10 parts by weight of the nitro cellulose binder, 1-200 part by weight of the binding agent formed of the (Ca, Ba, Sr)$CO_3$; and 50-500 parts by weight of the butyl acetate solvent.

According to a third exemplary embodiment of the present invention, a slurry composition is produced by mixing a fluorescent substance with the slurry composition prepared by the first or second examples in the weight ratio within a range of 1:1-3:1 and stirring the resulting mixture.

At this point, the slurry composition includes, per 100 parts by weight of the metal oxide selected from the group consisting of MgO, CaO, SrO, BaO, $ZrO_2$, and a combination thereof, 1-10 parts by weight of nitro cellulose binder, 1-500 parts by weight of the fluorescent substance, 1-200 parts by weight of the binding agent formed of the (Ca, Ba, Sr)$CO_3$; and 50-500 parts by weight of the butyl acetate solvent.

The slurry compositions according to the above examples may be applied to EEFLs or flat fluorescent lamps (FFLs), thereby increasing the lifetime and luminance of the fluorescent lamp.

The EEFL includes a cylindrical glass tube in which discharge gas is filled, a pair of external electrodes disposed at opposite outer ends of the glass tube, and a phosphor layer coated on the inner wall of the glass tube.

The FFL has a pair of flat glass substrates facing each other in parallel, discharge gas filled in a space defined between the glass substrates, a pair of external electrodes disposed at opposite outer ends of the glass tube, and a phosphor layer disposed on one of the flat glass substrates.

At this point, the application of the slurry composition on the fluorescent lamp is done by conducting a baking process after the slurry composition is wet-coated on the cylindrical glass tube or the flat glass substrate. The slurry composition may be used to form the passivation layer separately from the phosphor layer, or to form the phosphor layer depending on the content of the fluorescent substance. Each case will now be described with reference to the accompanying drawings illustrating EEFLs.

(i) Case Where the Slurry Composition is Used to Form the Passivation Layer Separately from the Phosphor Layer FIG. 1 is a sectional view of an EEFL according to an embodiment of the present invention.

Referring to FIG. 1, an EEFL 100 includes a glass tube 10 having a discharge space therein and a pair of external electrodes 16 disposed on opposite ends of the glass tube 10. A phosphor layer 14 is formed on an inner wall M of the glass tube 10 except at regions L and L' corresponding to the external electrodes 16, and a passivation layer 12 is formed on the regions L and L'.

As described above, the passivation layer 12 is formed only on the regions L and L' corresponding to the external electrodes 16, thereby preventing the deterioration of the glass tube 10, suppressing the increase of mercury gas consumption, and thus preventing the darkening phenomenon occurring at the opposite ends of the fluorescent lamp. Therefore, the lifetime and luminance of the fluorescent lamp are improved. Also, an amount of electron emission in the discharge space increases to reduce the drive voltage.

A method of manufacturing the fluorescent lamp having the passivation layer includes: forming a coating layer on an inner wall of the glass tube by coating a fluorescent slurry composition on the inner wall of the glass tube; removing the phosphor layer of the regions L and L' corresponding to the external electrodes through a brushing process; wet-coating the slurry composition of the present invention on the brushed regions L and L' of the glass tube; forming the phosphor and metal oxide layers simultaneously by baking the glass tube; exhausting air out of the glass tube; injecting the discharge gas into the glass tube; sealing the glass tube; and forming the external electrodes at the opposite ends of the glass tube.

The glass tube may be formed in a variety of shapes according to a type of the fluorescent lamp. That is, the glass tube may be a straight cylindrical type, a bulb type, or a flat tube type. In FIG. 1, the straight cylindrical tube type is illustrated.

In addition, the ingredients of the fluorescent slurry composition are the same as or highly compatible with those of the slurry composition of the present invention. The content of each ingredient of the fluorescent slurry composition is not limited to a specific level but may be the same as that of corresponding ingredients of the slurry composition of the present invention in order to conduct a succeeding process easily.

In the process of removing the phosphor layer, the fluorescent slurry composition coated on the regions L and L', on which the passivation layer will be formed in a succeeding process, is removed by applying physical force to the glass tube using a brush.

The process of wet-coating the slurry composition may be conducted using a conventional well-known process such as dip coating, roll coating, blade coating, slit coating, or spray coating.

The baking process is conducted at a temperature lower than the glass transition temperature, i.e., 350-600° C., so as to remove all organic ingredients contained in the fluorescent slurry composition as well as in the slurry composition of the present invention. Therefore, the fluorescent and passivation layers are formed by one baking process, thereby simplifying the manufacturing process and reducing the processing time.

The discharge gas may be mixture gas of mercury and argon or neon. However, the present invention is not limited to this. For example, a non-mercury discharge gas may also be used as the discharge gas.

After all of the above-described processes are performed, the EEFL is produced by forming the external electrodes at the opposite ends of the glass tube.

The external electrodes may be metal, which may form an electric field using an external current in order to emit light. However, the material of the electrodes is not specifically limited. At this point, the external electrodes are formed to fully enclose the opposite ends of the glass tube. The external electrodes may be manufactured in the form of a metal cap or a metal tape. Alternatively, the external electrodes may be formed by dipping the opposite ends of the glass tube into a metal solution. However, the method of forming the external electrodes is not limited thereto. That is, various methods may be used.

The thickness of the passivation layer may be within a range in which the thickness of the phosphor layer is set. Preferably, the thickness of the passivation layer may be within a range of 0.1-100 μm, and is more preferably 1.0-50 μm. At this point, the passivation layer is fixed on the glass tube by the binding agent, and the particle size of the metal oxide is within a range of 0.01-10 μm. The MgO passivation layer formed by the conventional deposition method has a thickness of less than 1 μm and is crystalline. However, the passivation layer of the present invention is amorphous.

(ii) Case Where the Slurry Composition of the Present Invention is Used to Form the Phosphor Layer Itself The slurry composition of the present invention may form the phosphor layer, instead of forming the phosphor and metal oxide layers separately, by mixing the fluorescent powder and the metal oxide in a predetermined weight ratio.

Figure 2:
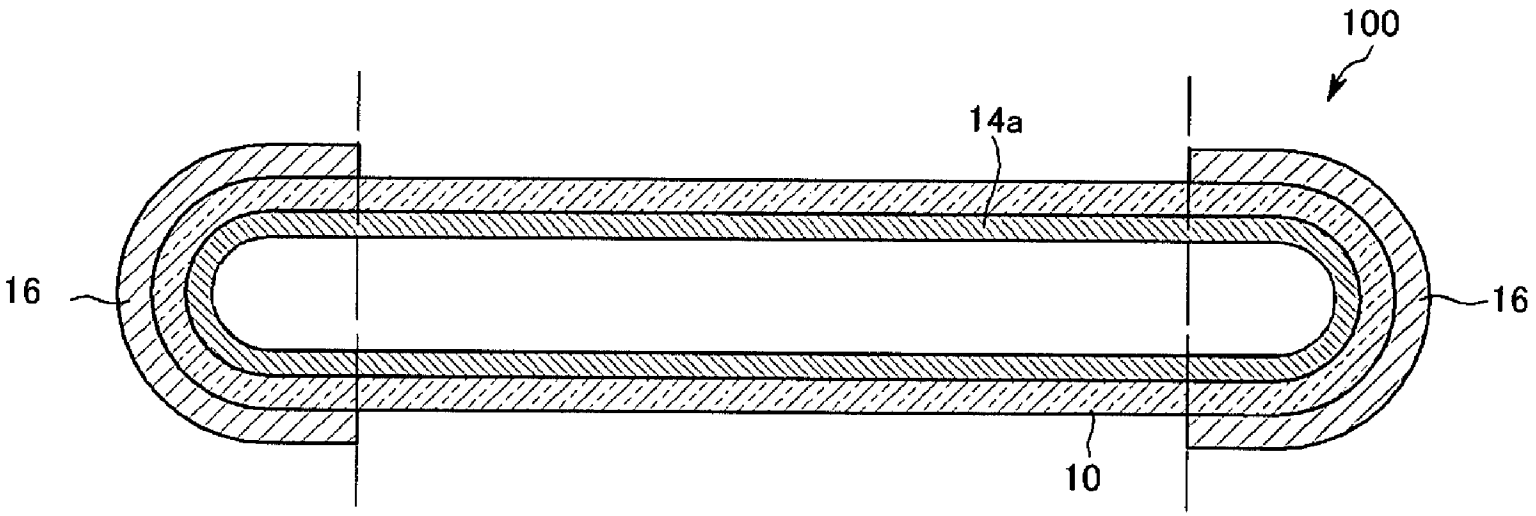
FIG. 2 is a longitudinal sectional view of an EEFL according to another exemplary embodiment of the present invention.

FIG. 2 is a sectional view of an EEFL according to another exemplary embodiment of the present invention.

Referring to FIG. 2, an EEFL 100 includes a glass tube 10 having a discharge space inside thereof and a pair of electrodes 16 formed on outer opposite ends of the glass tube 10. A phosphor layer **14*a* is formed on the entire inner wall of the glass tube 10 including the regions corresponding to the external electrodes 16**.

The fluorescent lamp having the phosphor layer 14*a* is produced by: wet-coating the composition including the fluorescent substance on the glass tube; baking the glass tube to form a phosphor layer containing the metal oxide; sealing the glass tube after exhausting air out of the glass tube and injecting the discharge gas into the glass tube; and forming the external electrodes at the outer opposite ends of the glass tube.

The wet coating and the forming of the external electrodes follow the foregoing exemplary embodiment. However, in the composition, the content of the fluorescent substance is greater than that of the metal oxide. Preferably, the weight ratio of the fluorescent substance to the metal oxide is within a range of 1:1-3:1.

The EEFLs according to the exemplary embodiments prevent the deterioration of the glass tube or the phosphor layer, which is caused by ions and electrons accelerated by high voltage, and thus suppress an increase of mercury gas consumption, thereby remarkably improving the lifetime and luminance of the fluorescent lamp. The fluorescent lamp may be used as a backlight unit of a flat panel display such as an LCD, a lighting lamp, or a light source of a signboard.

The following will describe examples of the present invention and comparative examples. However, the present invention is not limited to the examples set forth herein.

EXAMPLE 1

98 g of butyl acetate was injected into a mixer having a stirrer, and then 2 g of nitro cellulose was added and mixed uniformly with the butyl acetate.

2 g of a binding powder having CaP and CBB-based oxide that were mixed in a weight ratio of 1:1 was further added to the resulting mixture. At this point, before the binding power was added to the resulting mixture, a ball milling process for the binding powder was performed for 140 hours.

After that, 200 g of MgO powder was added to the resulting mixture, and the mixture was stirred to produce the slurry composition. Likewise, the ball milling process was conducted on the MgO powder before it was used in order to have a fine particle size.

EXAMPLE 2

98 g of butyl acetate was injected to a mixer having a stirrer, and then 2 g of nitro cellulose was added and mixed uniformly with the butyl acetate.

250 g of (Ca, Ba, Sr) carbonate, 8 g of $ZrO_2$ powder, and 250 g of MgO powder were mixed with each other. After that, a ball mill process was conducted for 10 hours to produce the slurry composition.

EXAMPLE 3

98 g of butyl acetate was injected to a mixer having a stirrer, and then 2 g of nitro cellulose was added. After that, the mixture was mixed uniformly.

150 g of (Ca, Ba, Sr) carbonate, 150 g of MgO powder, and 150 g of a fluorescent substance powder were mixed together. After that, the mixture was injected into the mixer to produce the slurry composition, after a ball mill process was conducted for 10 hours.

EXAMPLE 4

A passivation layer was formed on an EEFL using the slurry composition prepared in Example 1.

That is, the fluorescent slurry composition (phosphor:butylacetate=2:1) was coated on a glass tube having an outside diameter of 4 mm and a length of 500 mm. Then, regions of the coated fluorescent slurry composition, which corresponded to the external electrodes (a length of 25 mm), were brushed. After that, the slurry composition prepared in Example 1 was coated on the brushed regions by dipping the brushed region of the glass tube into the slurry composition.

Then, the glass tube was baked at a temperature of 550° C. in a furnace to form phosphor and passivation layers each having a thickness of 10.0 μm.

After that, air was exhausted from the glass tube, and the discharge gas was injected therein. Then 25 mm long external electrodes were formed to manufacture the EEFL.

COMPARATIVE EXAMPLE 1

Instead of forming a separate metal oxide layer, an EEFL was manufactured using a fluorescent slurry composition (phosphor:butylacetate=2:1) through the same method as Example 4.

EXPERIMENTAL EXAMPLE 1

Measuring a lamp current property according to a voltage applied.

In order to compare a current property of the EEFL of Example 4 with a current property of the EEFL of Comparative Example 1, the current properties according to the voltages applied were measured. The measured results are shown in FIG. 3.

Figure 3:
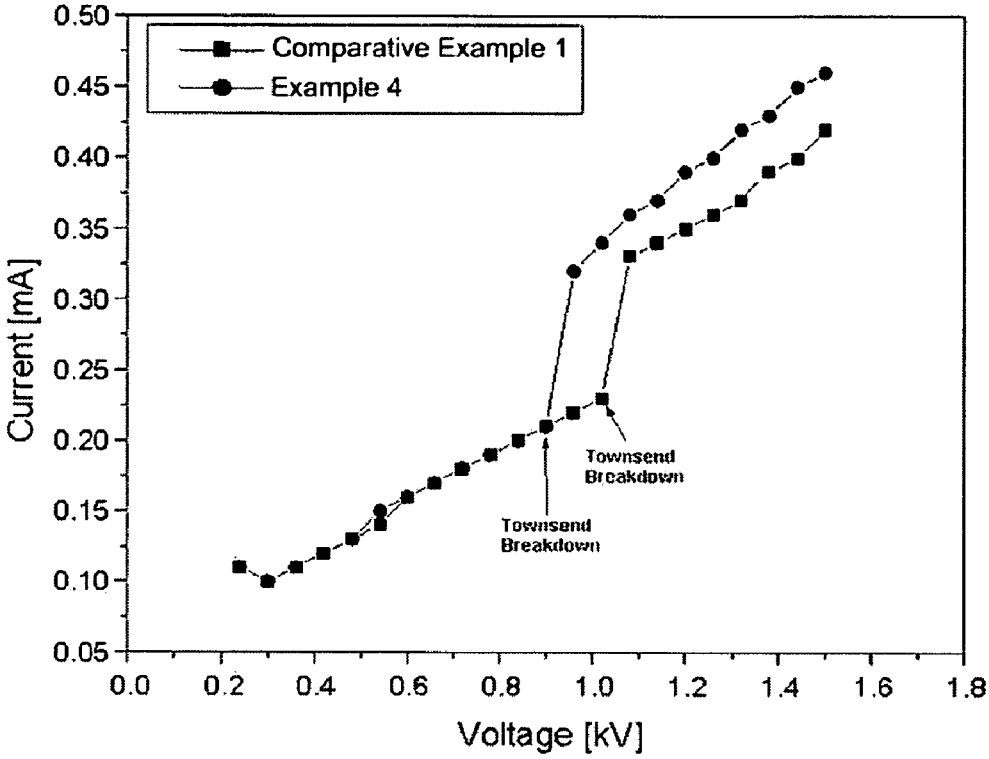
FIG. 3 is a current-voltage graph of an EEFL of Example 4 and an EEFL of Comparative Example 1.

Referring to FIG. 3 illustrating a voltage-current graph, it can be noted that the EEFL of Example 4, which has the MgO layer, has an initial Townsend discharge voltage lower than that of the EEFL of Comparative Example 1 by 150V. Moreover, it can also be noted that the current of the EEFL of Example 4 increased by 10% compared with that of the EEFL of Comparative Example 1 when identical voltages were applied to the EEFLs of the respective Example 4 and Comparative Example 1 even after the Townsend discharge is realized.

EXPERIMENTAL EXAMPLE 2

Measuring a luminance property according to electric power (watt) applied.

In order to compare a luminance property of the EEFL of Example 4 with that of the EEFL of Comparative Example 1, the luminances according to the power (watts) applied were measured. The measured results are shown in FIG. 4.

Figure 4:
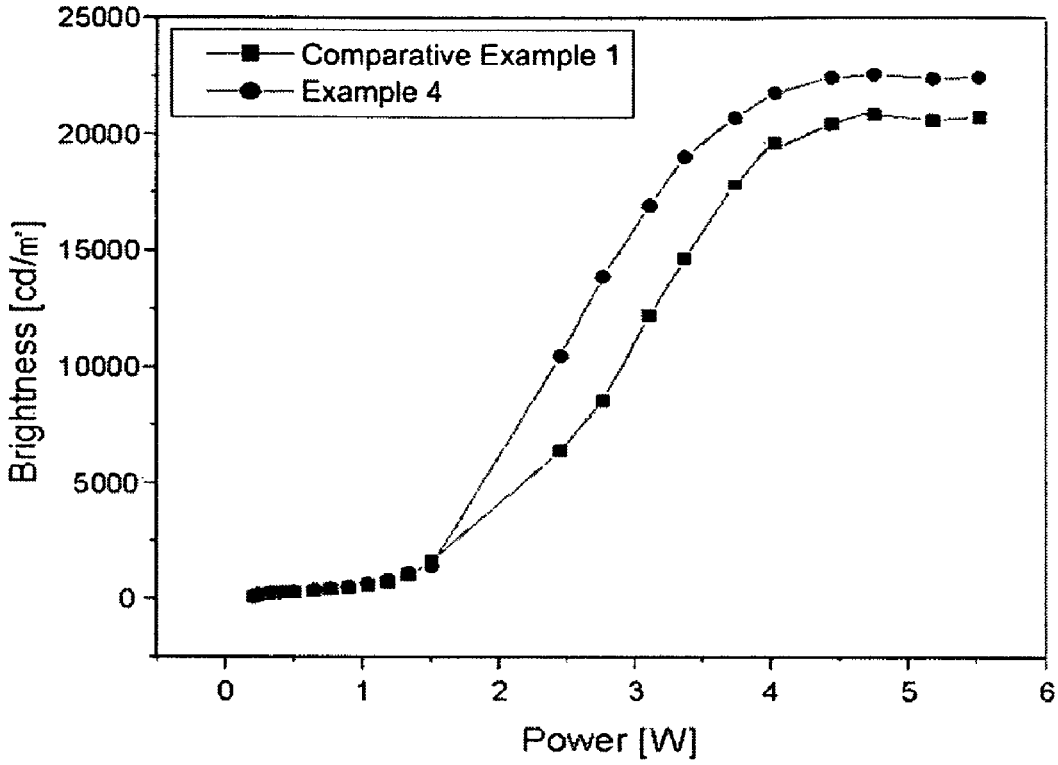
FIG. 4 is a power-luminance graph of the EEFL of Example 4 and the EEFL of Comparative Example 1.

Referring to FIG. 4 illustrating a power-luminance graph, it can be noted that luminance of the EEFL of Example 4 including the MgO layer is more enhanced compared with that of the EEFL of Comparative Example 1.

Also, a saturated luminance of the EEFL of Example 4 was 22,500 cd/$m^2$ while that of the EEFL of Comparative Example 1 was 20,000 cd/$m^2$. That is, it can be noted that the saturated luminance of the EEFL of Example 1 is better than that of the EEFL of Comparative Example q by 12.5%.

The present invention provides the slurry composition and the passivation layer is formed on the fluorescent lamp using the slurry composition. The fluorescent lamp may be an EEFL or an FFL, and the drive voltage may be reduced, thereby the lifetime and luminance is highly enhanced. The fluorescent lamp may be applied to a backlight unit of a flat panel display such as an LCD, a lighting lamp, or a light source for a signboard.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A slurry composition comprising:

100 parts by weight of a metal oxide selected from the group consisting of MgO, CaO, srO, BaO, ZrO3, and a combination thereof;

1-200 parts by weight of a binding agent per 100 parts by weight of the metal oxide, the binding agent being selected from the group consisting of calcium phosphate, a calcium-barium-boron-based (CBB-based) oxide, a triple carbonate ((Ca, Ba, Sr)$CO_3$), and a combination thereof;

1-10 parts by weight of a binder per 100 parts by weight of the metal oxide, the binder being selected from the group consisting of nitro cellulose, ethyl cellulose, methyl methacrylate, and a combination thereof; and 50-500 parts by weight of solvent per 100 parts by weight of the metal oxide.

2. The slurry composition of claim 1, wherein the solvent is selected from the group consisting of water, C1-C5 lower alcohol, C1-C5 alkyl acetate, C1-C4 alkyl cello solve, xylene, toluene, and a combination thereof.

3. The slurry composition of claim 1, further comprising one or more materials selected from the group consisting of a mercury abatement inhibitor and a dark property enhancer.

4. The slurry composition of claim 3, wherein the mercury abatement inhibitor is selected from the group consisting of Y3O3, CeO2, AhO3, and a combination thereof.

5. The slurry composition of claim 3,wherein the dark property enhancer is selected from the group consisting of Cs, $CsO_2$, $Cs_2O$, CS2SO4, CS(OH)2, and a combination thereof.

6. The slurry composition of claim 1, further comprising a fluorescent substance.

7. The slurry composition of claim 6, wherein a weight ratio of the metal oxide to the fluorescent substance is within a range of 1:100-100:1.

8. The slurry composition of claim 1, wherein the binder is included at 1-10 a parts by weight as the nitro cellulose per 100 parts by weight of the metal oxide;

the binding agent is included at 1-50 parts by weight as a mixture including the calcium phosphate and the calcium-barium-boron-based (CBB-based) oxide, which are mixed in a weight ratio of 1:1, per 100 parts by weight of the metal oxide; and the solvent is included at 50-500 parts by weight as butyl acetate per 100 parts by weight of the metal oxide.

9. The slurry composition of claim 1, wherein the binder is included at I-I a parts by weight as the nitro cellulose per 100 parts by weight of the metal oxide;

the binding agent is included at 1-200 parts by weight as the triple carbonate ((Ca, Ba, Sr)$CO_3$) per 100 parts by weight of the metal oxide; and the solvent is included at 50-500 parts by weight as butyl acetate per 100 parts by weight of the metal oxide.

10. The slurry composition of claim 6, wherein the binder is included at 1-10 parts by weight of the nitro cellulose per 100 parts by weight of the metal oxide;

the fluorescent substance is included at 1-500 parts per 100 parts by weight of the metal oxide;

the binding agent is included at 1-200 parts by weight as the triple carbonate ((Ca, Ba, Sr)$CO_3$) per 100 parts by weight of the metal oxide; and the solvent is included at 50-500 parts by weight as butyl acetate.

* * * * *